US005645341A

United States Patent [19]

Liao

[11] Patent Number: 5,645,341

[45] Date of Patent: Jul. 8, 1997

[54] WALL LAMP

[76] Inventor: King-Pro Liao, No. 3, Lane 121, Chienhsing Rd., Taya Hsiang, Taichung Hsien, Taiwan

[21] Appl. No.: 714,767

[22] Filed: Sep. 16, 1996

[51] Int. Cl.[6] ..... F21L 7/00

[52] U.S. Cl. ..... 362/183

[58] Field of Search ..... 362/183, 190, 362/191

[56] References Cited

U.S. PATENT DOCUMENTS 4,345,304 8/1982 Penny et al. ..... 362/183

*Primary Examiner*—Carroll B. Dority
*Attorney, Agent, or Firm*—Watson Cole Stevens Davis, P.L.L.C.

[57] ABSTRACT

A wall lamp includes a lamp fixture having a plate, a lampshade enclosing the plate and defining a hole at a bottom end thereof, a first bulb, a lamp socket mounted on the plate for receiving the first bulb, and a pull switch with a pull cord for controlling the first bulb, a pedestal extending downward from the bottom end of the lamp fixture and having a base perpendicularly extending from the bottom thereof, an L-shaped tongue protruding from an upper portion of the pedestal, and a plurality of contact points disposed on the base, a flashlight composed of a plastic housing having a suspension rod for engaging with the tongue and a head portion to extend through the hole of the lampshade, retained on the pedestal, and electrically connected with the contact points by means of a plurality of contact pins, a rechargeable battery provided within the plastic housing, a second bulb, a power switch on the plastic housing for controlling the second bulb, and a control means for providing the circuits required by the lamp fixture and the flashlight.

19 Claims, 5 Drawing Sheets

WALL LAMP

BACKGROUND OF THE INVENTION

1. Field of the Invention

The present invention relates to a wall lamp, and more particularly to a wall lamp with a flashlight which can be a normal light source and an emergency light source when an electric mains supply is interrupted.

2. Description of Related Art

Conventional emergency lamps used in the case of electric mains failure generally are fixed on a wall. This kind of lamp does not have an anesthetically pleasing appearance and has only one function of providing emergency illumination. Furthermore, as such a conventional lamp is too heavy to carry, it is inconvenient for a user to use it as a flashlight in the dark.

The present invention provides an improved wall lamp with a flashlight to mitigate and/or obviate the aforementioned problems.

SUMMARY OF THE INVENTION

One object of the present invention is to provide a wall light with a flashlight for providing a normal illumination and an emergency illumination in the case of electric mains failure.

Another object of the present invention is to provide a wall lamp with a flashlight having a function of saving electrical energy by turning off the emergency wall lamp when the flashlight is not removed from the wall lamp after a predetermined of time from the mains failure.

A further object of the present invention is to provide a combined wall lamp and flashlight having a function of fire alarm.

A wall lamp with a flashlight in accordance with the present invention includes a lamp fixture having a plate, a lampshade enclosing the plate and defining a hole at a bottom end thereof, a first bulb, a lamp socket mounted on the plate for receiving the first bulb, and a pull switch with a pull cord for controlling the first bulb, a pedestal extending downward from the bottom end of the lamp fixture and having a base perpendicularly extending from the bottom thereof, an L-shaped tongue protruding from an upper portion of the pedestal, and a plurality of contact points disposed on the base, a flashlight composed of a plastic housing having a suspension rod for engaging with the tongue and a head portion to extend through the hole of the lampshade, retained on the pedestal, and electrically connected with the contact points by means of a plurality of contact pins, a rechargeable battery provided within the plastic housing, a second bulb, a power switch on the plastic housing for controlling the second bulb, and a control means for providing the circuits required by the lamp fixture and the flashlight.

Other objects, advantages and novel features of the invention will become more apparent from the following detailed description when taken in conjunction with the accompanying drawings.

DETAILED DESCRIPTION OF PREFERRED EMBODIMENT

Figure 1:
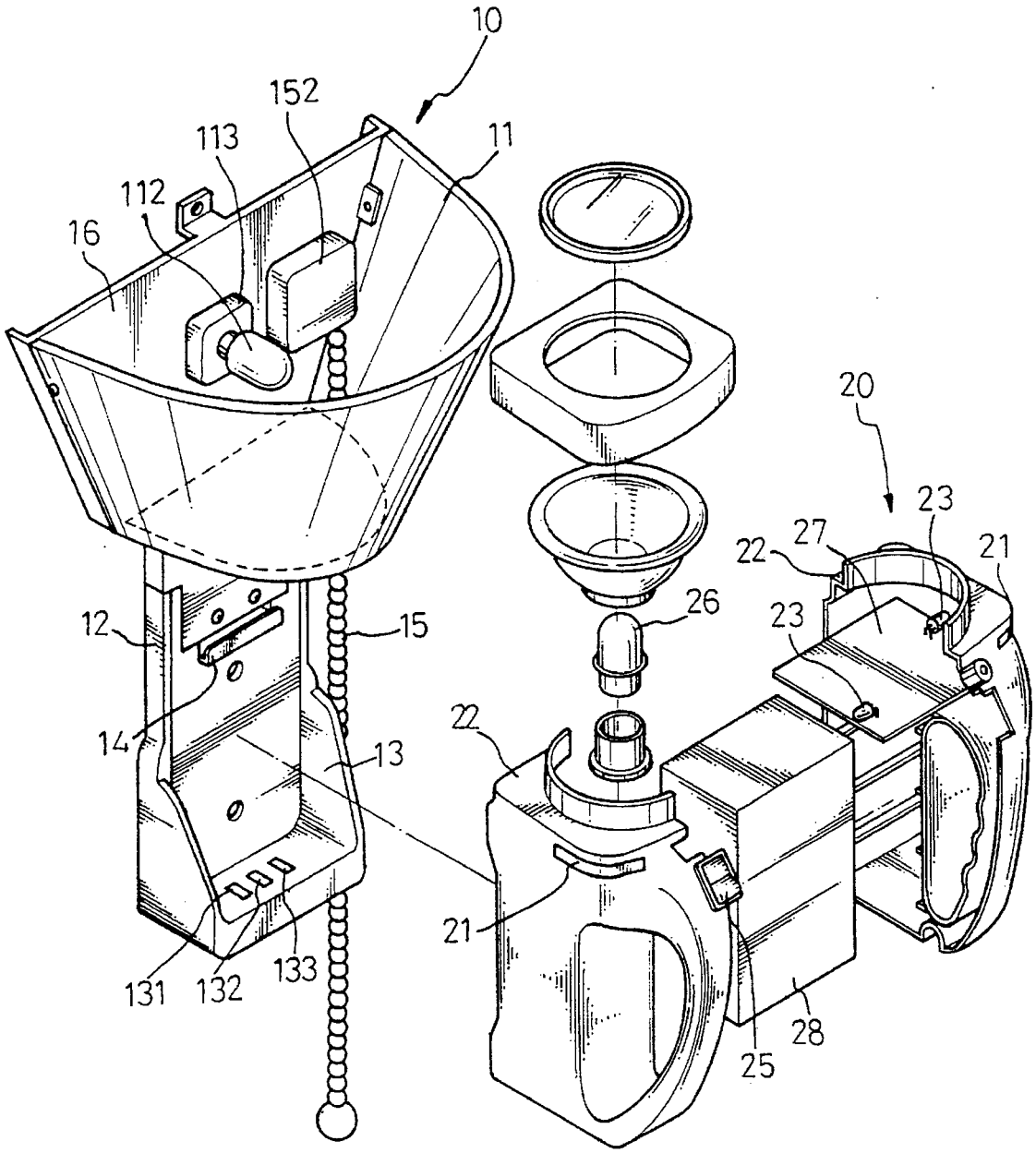
FIG. 1 is a perspective exploded view showing the wall lamp in accordance with the present invention.
Figure 3:
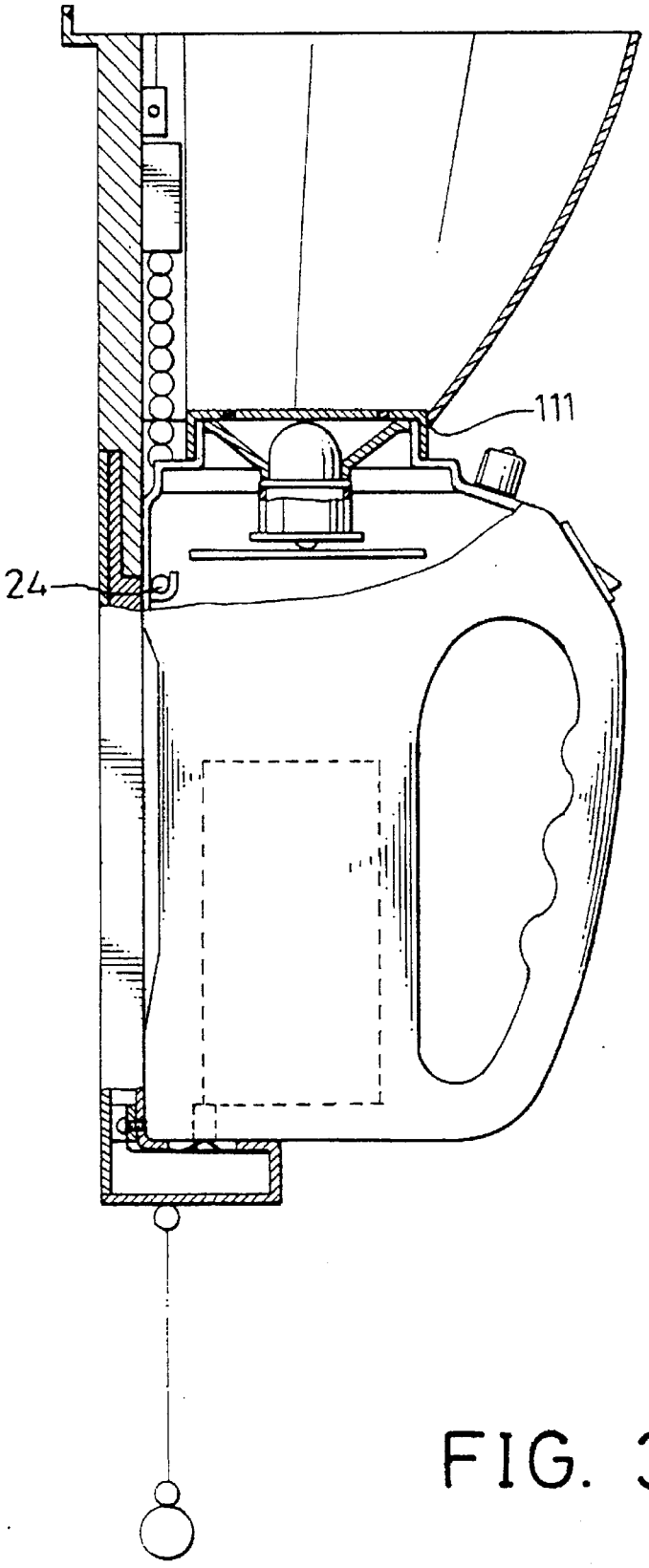
FIG. 3 is a side view partially cut-away showing the wall lamp in accordance with the present invention.

Referring to FIG. 1, the wall lamp in accordance with the present invention includes a lamp fixture 10, a lamp pedestal 12 extending downward from a bottom end of the fixture 10, and a flashlight 20. The lamp fixture 10 has a plate 16, a lampshade 11 enclosing the plate 16, a light bulb 112 and a lamp socket 113 fixed into the plate 16, a pull switch 152 with a pull cord 15 mounted on the plate 16 for controlling the bulb 112. A hole 111 (in FIG. 3) is defined at a bottom end of the lampshade 11 and the plate 16 for a head portion of the flashlight 20 to extend therethrough. The pedestal 12 has an L-shaped tongue 14 at an upper portion of the pedestal 12, a base 13 perpendicularly extending from the bottom thereof, and three contact points 131, 132 and 133 disposed on the base 13 for electrically connecting with the flashlight 20.

The flashlight 20 is composed of a plastic housing 22, a bulb 26, a circuit board 27, and a rechargeable battery 28. The plastic housing 22 is further provided with a suspension rod 24 (in FIG. 3) within the plastic housing 22 and facing the tongue 14 of the base 13 as to engage with the tongue 14 when the flashlight 20 is placed on the base 13. The housing 22 is further provided with two transparent windows 21 and a power switch 25 for controlling the ON/OFF of the flashlight 20. Two LEDs 23 of different colors are mounted on the printed circuit board 27 and each of the LEDs 23 faces one of the transparent windows 21 for indicating the status of the flashlight 20, such as the flashlight is charging and the power source is interrupted.

Figure 2:
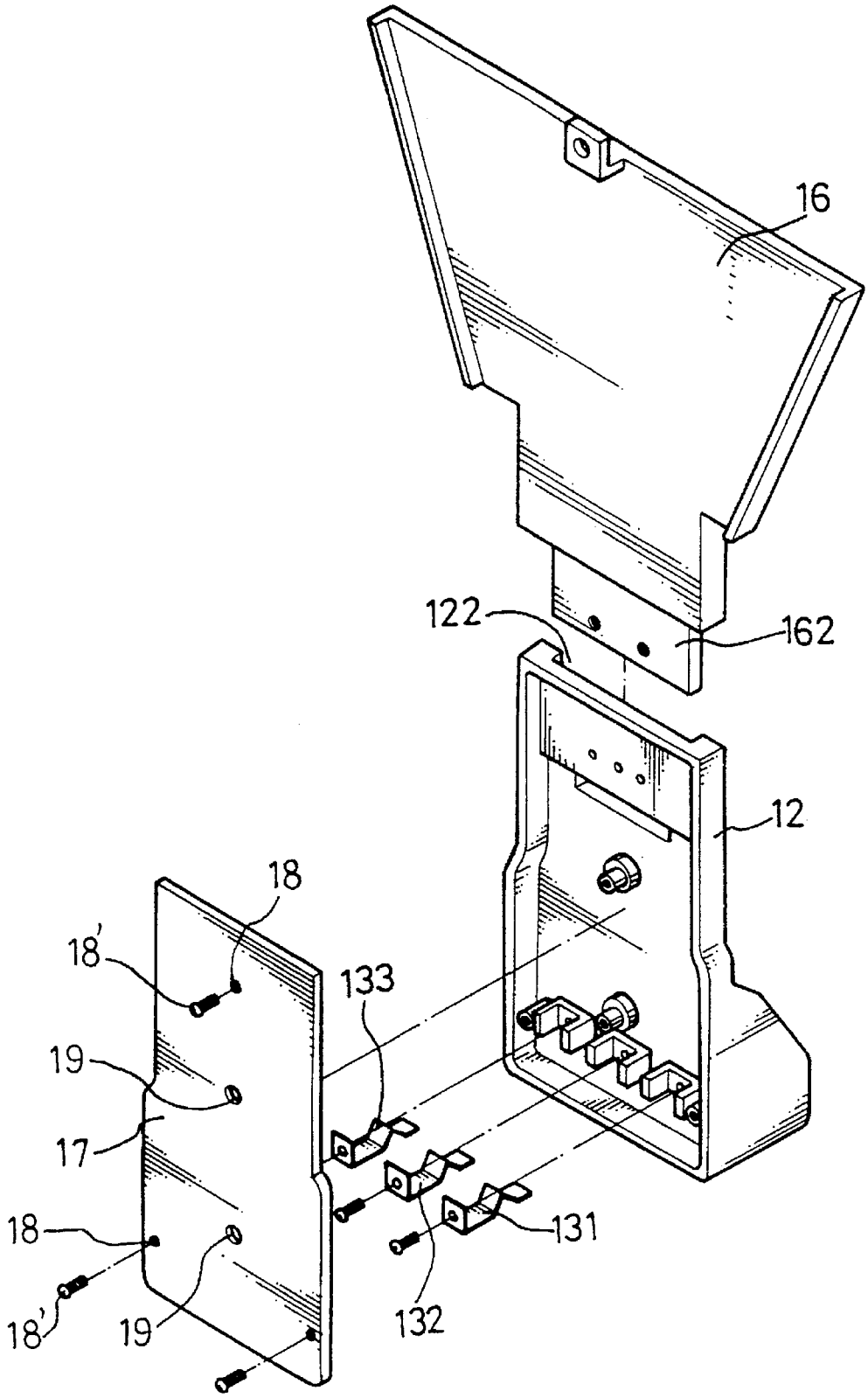
FIG. 2 is a perspective exploded view showing a pedestal of the wall lamp in accordance with the present invention.
Figure 4:
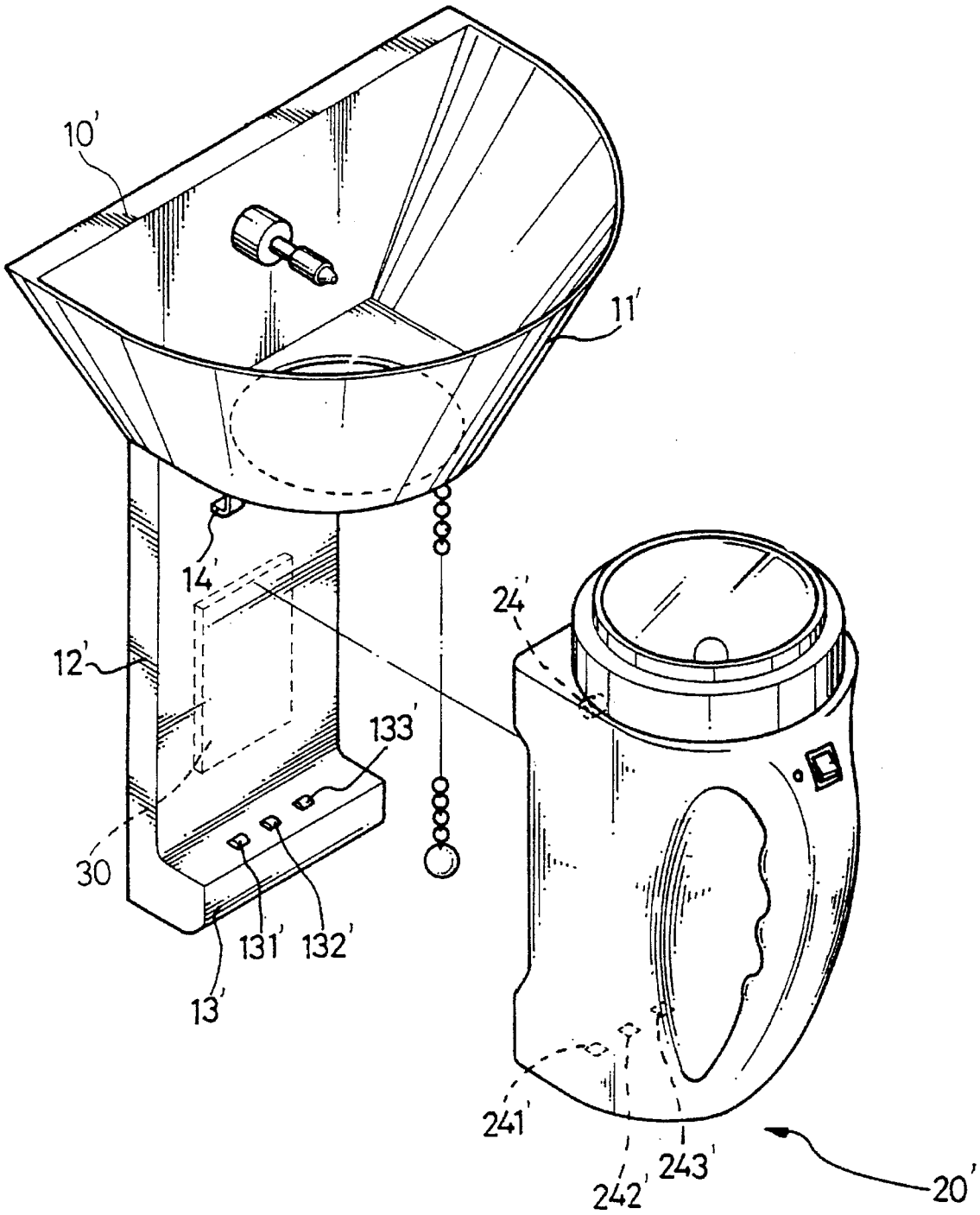
FIG. 4 is a perspective view showing the wall lamp in accordance with the second embodiment of the present invention.

Referring to FIG. 2, a cover plate 17 is provided on a rear portion of the pedestal 12, three apertures 18 are defined in a periphery portion thereof for screws 18' to extend therethrough as to secure the plate 17 onto the pedestal 12, and two holes 19 are defined thereon for screws (not shown) to extend therethrough as to secure the pedestal 12 onto a wall (not shown), Referring to FIG. 4, three contacts pins 241', 242', and 243' are provided under a bottom of the flashlight 20' for electrically connecting to the contact points 131', 132', 133' on the base 13' as to charge the battery (not shown) in the flashlight 20'. The lamp fixture 10' and the pedestal 12' are integrally formed. An L-shaped hook 14' is provided under a bottom end of a lampshade 11' for hanging a corresponding hole 24' defined in a head portion of the flashlight 20'. A printed circuit board 30 is provided within the pedestal 12'.

Figure 5:
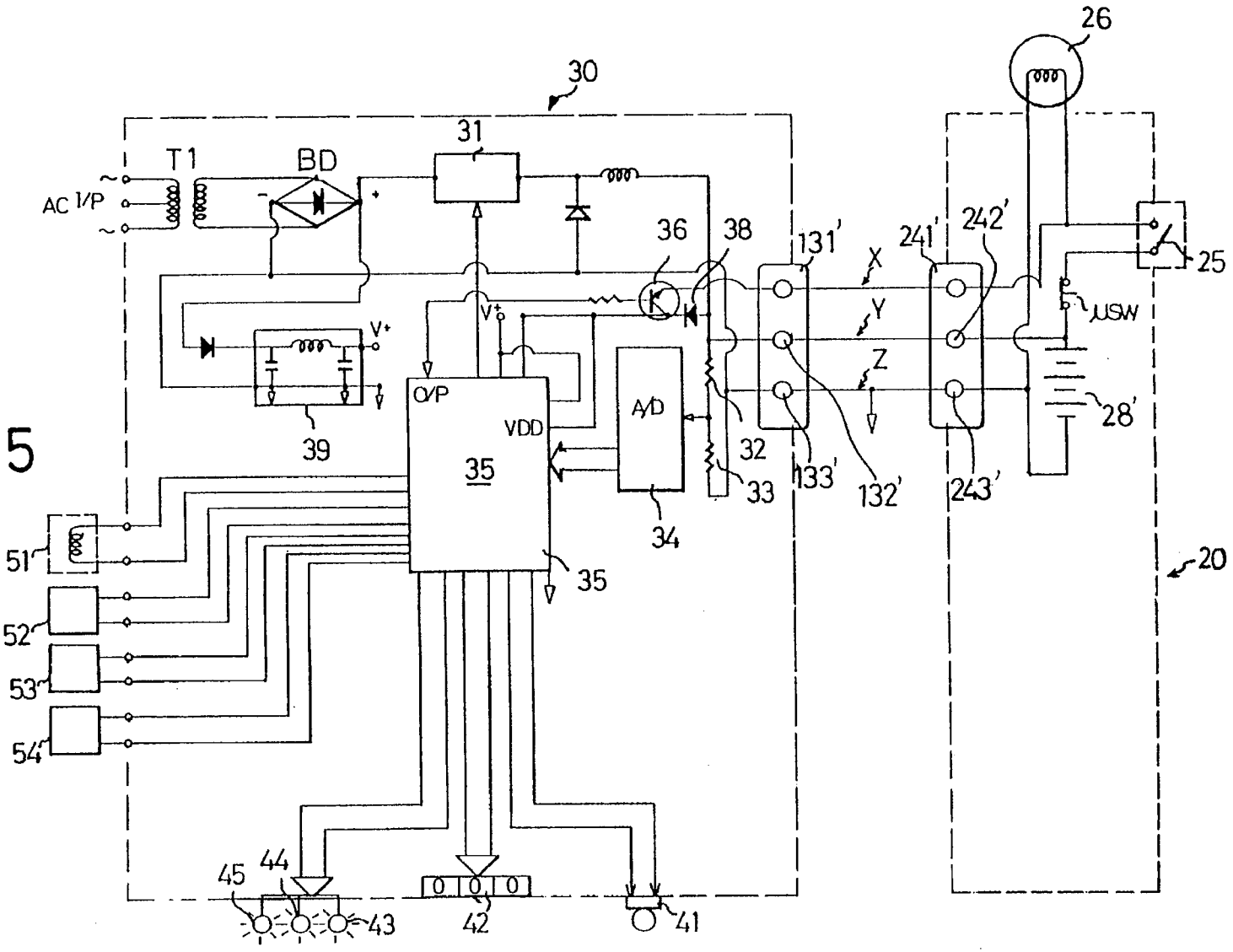
FIG. 5 is a circuit diagram of the wall lamp in accordance with the present invention.

Referring to FIG. 5, the flashlight 20 is composed of a rechargeable battery 28', a power switch 25, a bulb 26, three contact pins 241', 242', 243', and a microswitch μSW. When the flashlight 20 is placed onto the pedestal 12' (in FIG. 4), the contact pins 241', 242', 243' will be electrically connected to the printed circuit board 30 within the pedestal 12'. The microswitch μSW will be turned off so as to disconnect an interconnection between the rechargeable battery 28' and the power switch 25 thereby actually turning off the bulb 26 in case of that the power switch 25 is not turned off.

An alternative current (AC) signal from an AC supply, shown at a top of the left side of the figure, is input to a step-down transformer T1 and then rectified by a bridge rectifier BD. The rectified signal is then input to an LC filter 39 to supply a direct current (DC) power required by the printed circuit board 30. The bridge rectifier BD is further electrically connected to the connection points 131', 132', and 133' via a single-chip microprocessor 35, a switching mode charger 31, two divider resistors 32, 33 and an analog-to-digital converter 34 for supply power to the rechargeable battery 28' of the flashlight 20 and which automatically stops charging when the power of the battery 28' is at maximum. Once an electric mains failure occurs, the power from the rechargeable battery 28' on the flashlight 20 will be supplied to the single-chip microprocessor 35 through a diode 38, while making an output (O/P) of the microprocessor 35 at a high level in logic and thus making the connection point 131' at a high level by means of turning on a transistor 36 as to turn on the bulb 26. In the case that only the flashlight 20 is required for use, the flashlight 20 may be taken down from the wall lamp. In this case, the circuit of the flashlight 20 is separated from the circuit board 30 within the wall lamp so that the microswitch μSW is switched on and the interconnection between the rechargeable battery 28' and the power switch 25 is recovered. Therefore, the flashlight 20 can be portable by the user and the bulb 26 can be lit by switching the power switch 25 on the flashlight 20.

The single-chip microprocessor 35 in accordance with the present invention is further provided with functions of a self-interrupted emergency light after a predetermined period of time and a fire alarm. These are accomplished by means of providing a timing switch 42, a buzzer 41, an alarm indicator 43, a charging indicator 44, and a power indicator 45, which are respectively connected to a plurality of input/output ports of the single-chip microprocessor 35. The timing switch 42 is provided for determining an illumination duration of the bulb 26 in case of electric mains source failure so as to cut off the battery-supplied power for the purpose of saving electric power after a period of time a user does not remove the flashlight from the pedestal 12'.

Alternatively, an infrared sensor (not shown) can also be connected to an input port of the single-chip microprocessor 35 so as to automatically turn on the bulb 26 again when the sensor detects a user's approach. The buzzer 41 and the alarm indicator 43 are used as fire alarms. A temperature detector (not shown) and a smoke detector (not shown) may be connected to an output port or the output circuits 51, 52, 53, 54 of the single-chip microprocessor 35 to process the detection signals from the detectors and control other operations. Therefore, the wall lamp in accordance with the present invention not only can be used for illumination but also provided with functions of a fire alarm and timing a power cut-off.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A wall lamp comprising;

a lamp fixture having a plate, a lampshade enclosing the plate and defining a hole at a bottom end thereof, a first bulb, a lamp socket mounted on the plate for receiving the first bulb, and a pull switch with a pull cord for controlling the first bulb;

a pedestal extending downward from the bottom end of the lamp fixture and having a base perpendicularly extending from the bottom thereof, an L-shaped tongue protruding from an upper portion of the pedestal, and a plurality of contact points disposed on the base;

a flashlight composed of a plastic housing having a suspension rod for engaging with the tongue and a head portion to extend through the hole of the lampshade, retained on the pedestal, and electrically connected with the contact points by means of a plurality of contact pins, a rechargeable battery provided within the plastic housing, a second bulb, a power switch on the plastic housing for controlling the second bulb; and a control means for providing the circuits required by the lamp fixture and the flashlight.

2. A wall lamp as claimed in claim 1, wherein said control means comprises a printed circuit board provided within the flashlight.

3. A wall lamp as claimed in claim 2, wherein said printed circuit board provides two LEDs of different colors for indicating the status for the wall lamp.

4. A wall lamp as claimed in claim 3, wherein said plastic housing of the flashlight further defines two transparent windows for the LEDs to emit light therethrough.

5. A wall lamp as claimed in claim 1, wherein said plate and pedestal are integrally formed.

6. A wall lamp as claimed in claim 1, wherein said control means comprises a printed circuit board provided within the pedestal.

7. A wall lamp as claimed in claim 6, wherein said flashlight comprises a microswitch for electrically connecting the rechargeable battery and the power switch when the flashlight is removed from the wall lamp.

8. A wall lamp as claimed in claim 6, wherein said printed circuit board comprises a single-chip microprocessor, an alternative charger, a pair of divider resistors and an analog-to-digital converter, the single-chip microprocessor having one output electrically connected with the rechargeable battery and the second bulb via a transistor so as to automatically turn on the second bulb when an electric mains source is interrupted.

9. A wall lamp as claimed in claim 8, wherein the single-chip microprocessor has a plurality of output and input ports to be connected with a fire sensor, a smoke sensor, a number of indicators, a buzzer and output circuits, respectively.

10. A wall lamp as claimed in claim 9, wherein one of the input ports of the single-chip microprocessor is connected with a timing switch for setting a duration of lighting of the bulb in the case of a mains electricity failure.

11. A wall lamp comprising;

a pedestal and a base perpendicularly extending from a bottom of the pedestal, an L-shaped tongue protruding from an upper portion of the pedestal, and a plurality of contact points disposed on the base;

a flashlight composed of a plastic housing having a suspension rod for engaging with the L-shaped tongue of the pedestal thereby retaining the flashlight on the pedestal, corresponding number of contact pins formed at a bottom of the plastic housing for electrically connecting with the contact points of the base, a rechargeable battery provided within the plastic housing, a bulb, and a power switch on the plastic housing for controlling the bulb; and a control means for electrically controlling the flashlight.

12. A wall lamp as claimed in claim 11, wherein said control means comprises a printed circuit board provided within the flashlight.

13. A wall lamp as claimed in claim 12, wherein said printed circuit board provides two LEDs of different colors for indicating the status for the wall lamp.

14. A wall lamp as claimed in claim 13, wherein said plastic housing of the flashlight further defines two transparent windows for the LEDs to emit light therethrough.

15. A wall lamp as claimed in claim 11, wherein said control means comprises a printed circuit board provided within the pedestal.

16. A wall lamp as claimed in claim 15, wherein said flashlight comprises a microswitch for electrically connecting the rechargeable battery and the power switch when the flashlight is removed from the wall lamp.

17. A wall lamp as claimed in claim 15, wherein said printed circuit board comprises a single-chip microprocessor, an alternative charger, a pair of divider resistors and an analog-to-digital converter, the single-chip microprocessor having one output electrically connected with the rechargeable battery and the bulb via a transistor so as to automatically turn on the bulb when an electric mains source is interrupted.

18. A wall lamp as claimed in claim 17, wherein the single-chip microprocessor has a plurality of output ports to be connected with a number of indicators, a buzzer, and output circuits, and input ports to be connected with a fire sensor and a smoke sensor.

19. A wall lamp as claimed in claim 18, wherein one of the input ports of the single-chip microprocessor is connected with a timing switch for setting a duration of lighting of the bulb in the case of a mains electricity failure.

* * * * *